US005139169A

United States Patent [19]

Boyer

[11] Patent Number: 5,139,169

[45] Date of Patent: Aug. 18, 1992

[54] CARBONATED BEVERAGE DISPENSING SYSTEM

[76] Inventor: Richard L. Boyer, 18 Colonial Pl., Asheville, N.C. 28804

[21] Appl. No.: 658,514

[22] Filed: Feb. 21, 1991

[51] Int. Cl.[5] ..... B65D 35/28

[52] U.S. Cl. ..... 222/103; 222/105; 222/107; 222/326; 74/89.18; 100/288; 383/119

[58] Field of Search ..... 222/95, 103, 105, 107, 222/185, 326, 327, 214, 215, 386, 390; 74/89.18, 89.11; 220/666, 672, 670, 674, 669; 100/288; 383/16, 119

[56] References Cited

U.S. PATENT DOCUMENTS

| | | | |
|---|---|---|---|
| 280,333 | 6/1883 | Summers | 100/288 |
| 1,197,824 | 9/1916 | Hess | 100/288 |
| 2,106,494 | 1/1938 | Debor | 220/669 |
| 3,450,309 | 6/1969 | Millo | 222/103 |
| 3,565,292 | 2/1971 | Jinotti | 222/103 |
| 3,902,635 | 9/1975 | Jinotti | 222/103 |
| 4,155,304 | 5/1979 | Schweisser et al. | 222/95 |
| 4,756,450 | 7/1988 | Negaty-Hindi et al. | 222/95 |
| 4,989,743 | 2/1991 | Lowery | 222/103 |
| 5,025,953 | 6/1991 | Doundoulakis | 222/102 |

FOREIGN PATENT DOCUMENTS

| | | | |
|---|---|---|---|
| 2178001 | 2/1987 | United Kingdom | 222/95 |
| 2208113 | 3/1989 | United Kingdom | 222/219 |

*Primary Examiner*—Andres Kashnikow
*Assistant Examiner*—Philippe Derakshani
*Attorney, Agent, or Firm*—Carter & Schnedler

[57] ABSTRACT

There is provided an improved carbonated drink dispensing system including a semi-rigid plastic collapsible bladder which holds the carbonated beverage and a dispensing apparatus which receives the semi-rigid bladder. The bladder includes a plurality of ribs to provide additional strength. The dispensing apparatus and bladder are generally cylindrical in shape. The dispensing apparatus includes a top pressure plate for applying downward pressure to the top of the bladder as the beverage is dispensed thereby collapsing a portion of the bladder so as to keep appropriate pressure within the bag thus preventing the escape of carbonation from the beverage. A gearing mechanism to provide a mechanical advantage is utilized in connection with the movement of the pressure plate.

19 Claims, 6 Drawing Sheets

CARBONATED BEVERAGE DISPENSING SYSTEM

BACKGROUND OF THE INVENTION

This invention relates to a dispensing apparatus for carbonated beverages. More particularly, it relates to an apparatus for storing and dispensing carbonated beverages such as beer and soft drinks in bulk packages such as a keg.

Carbonated beverages such as beer and soft drinks are sold in small individual servings utilizing cans and bottles and in bulk utilizing rigid pressurized canisters known in some instances as kegs. When kegs are used an air pump is required to maintain proper pressure within the keg as the beverage is dispensed so that carbonation is not lost from the beverage to the void created by the loss of the beverage.

The great advantage of utilizing a keg over a bottle or can is the cost savings in packaging. In the soft drink industry where cans and bottles are used, packaging often accounts for up to 60% of the total cost of the beverage product and in the beer industry packaging may be up to 40% of the total cost. However, by using a returnable keg, the packaging cost is substantially reduced. However the use of a rigid keg has certain disadvantages. The kegs are expensive to manufacture, are heavy, and must be returned to the brewery or bottling plant to be cleaned, sterilized and refilled, which adds to the cost. The return trip to the plant with empty kegs also results in fuel cost. Furthermore, for use in the home traditional metal kegs are cumbersome and a substantial deposit is required for the keg and an associated pump assembly.

In the past there have been attempts to utilize bags to carry and dispense carbonated beverages in bulk. Two such attempts are disclosed in U.S. Pat. No. 4,854,483 issued to Haggart, and U.S. Pat. No. 4,623,075 issued to Riley. The Haggart patent discloses the use of a polyethylene bag filled with a carbonated beverage. The bag is received inside a reinforced cardboard and plastic carton. A diaphragm is used to supposedly compress the plastic bag, preserving carbonation of the beverage.

The Riley patent discloses the use of a collapsible bag filled with a carbonated beverage which is received within a spiral wound cardboard cylinder which in turn is received within a cardboard box. An enclosing sleeve having an elastic memory so as to counteract outer pressure of the bag is discussed.

U.S. Pat. No. 4,756,450 issued to Negaty-Hindi shows a bag which receives a carbonated beverage which in turn is received within a chamber. Negaty-Hindi utilizes resilient elements such as giant rubber bands to power a disk for exerting force on the bag as the beverage is dispensed to preserve carbonation. Negaty-Hindi also shows a spiral spring to push against the liquid filled bag. A ratchet mechanism also is utilized to retain the disk when the pressure in the bag becomes higher than the atmospheric pressure.

It is not believed that any of the above described beverage dispensing systems have met with substantial commercial success.

OBJECTS OF THE INVENTION

It is therefore one object of this invention to provide an improved carbonated beverage dispensing system.

It is another object to provide an improved package for containing a carbonated beverage which is useful in connection with the storage and dispensing of the carbonated beverage in bulk.

It is another object to provide an improved apparatus for dispensing carbonated beverages in bulk without the need of adding gas to the package containing the carbonated beverage as the carbonated beverage is dispensed.

It is another object to provide a carbonated beverage dispensing system which utilizes a disposable beverage containing package and which is inexpensive and easy to use.

It is another object to provide a bulk carbonated beverage dispensing system which is particularly adaptable for consumer use.

SUMMARY OF THE INVENTION

In accordance with one form of this invention, there is provided a carbonated beverage dispensing apparatus including a housing which, preferably, is cylindrically shaped. The housing is adapted to receive a bladder which contains a carbonated beverage. A moveable pressure plate forms the top of the housing. A dispensing mechanism is adapted to be attached to the bladder. A mechanism is provided for moving the pressure plate downwardly as the beverage is dispensed from the bladder whereby the volume of the bladder is reduced and pressure is maintained within the bladder so that the carbonation of the beverage is substantially maintained. The dispensing apparatus preferably includes a means such as at least one gear mechanism for providing a mechanical advantage for moving the pressure plate downwardly on the bladder as the beverage is removed therefrom.

In accordance with another form of this invention, there is provided a package for containing a carbonated beverage. The package includes a bladder, as stated above, which receives the beverage. The bladder preferably also is cylindrically shaped when substantially filled with the beverage. The bladder has a top and a bottom. A mechanism is provided for permitting the beverage to be removed from the bladder. A substantial portion of the bladder is made of a semi-rigid material whereby the bladder will collapse, thereby reducing its volume as the beverage is removed therefrom and external pressure is provided thereto. Preferably the bladder is made of a plastic material such as high density polyester so that the carbon dioxide which forms the carbonation ($CO_2$) of the beverage will not readily permeate through the bladder. Also, preferably a plurality of ribs are formed about the bladder. The ribs may be formed by attaching horizontal straps around the bladder. Also a top and bottom plate which are connected together by a plurality of outside, vertical straps may also be provided which is particularly useful in transporting and storing the bladder prior to its insertion within the dispensing apparatus. Thus a novel carbonated beverage dispensing apparatus and a novel package for containing the carbonated beverage are provided resulting in an easy to use and low cost system for dispensing carbonated beverages in bulk without the need for expensive and hard to manage rigid kegs and associated pumping equipment.

BRIEF DESCRIPTION OF THE DRAWINGS

The subject matter which is regarded as the invention is set forth in the appended claims. The invention itself, however, together with further objects and advantages thereof may be better understood by reference to the following description taken in conjunction with the accompanying drawings in which:

DESCRIPTION OF THE PREFERRED EMBODIMENTS

Figure 1:
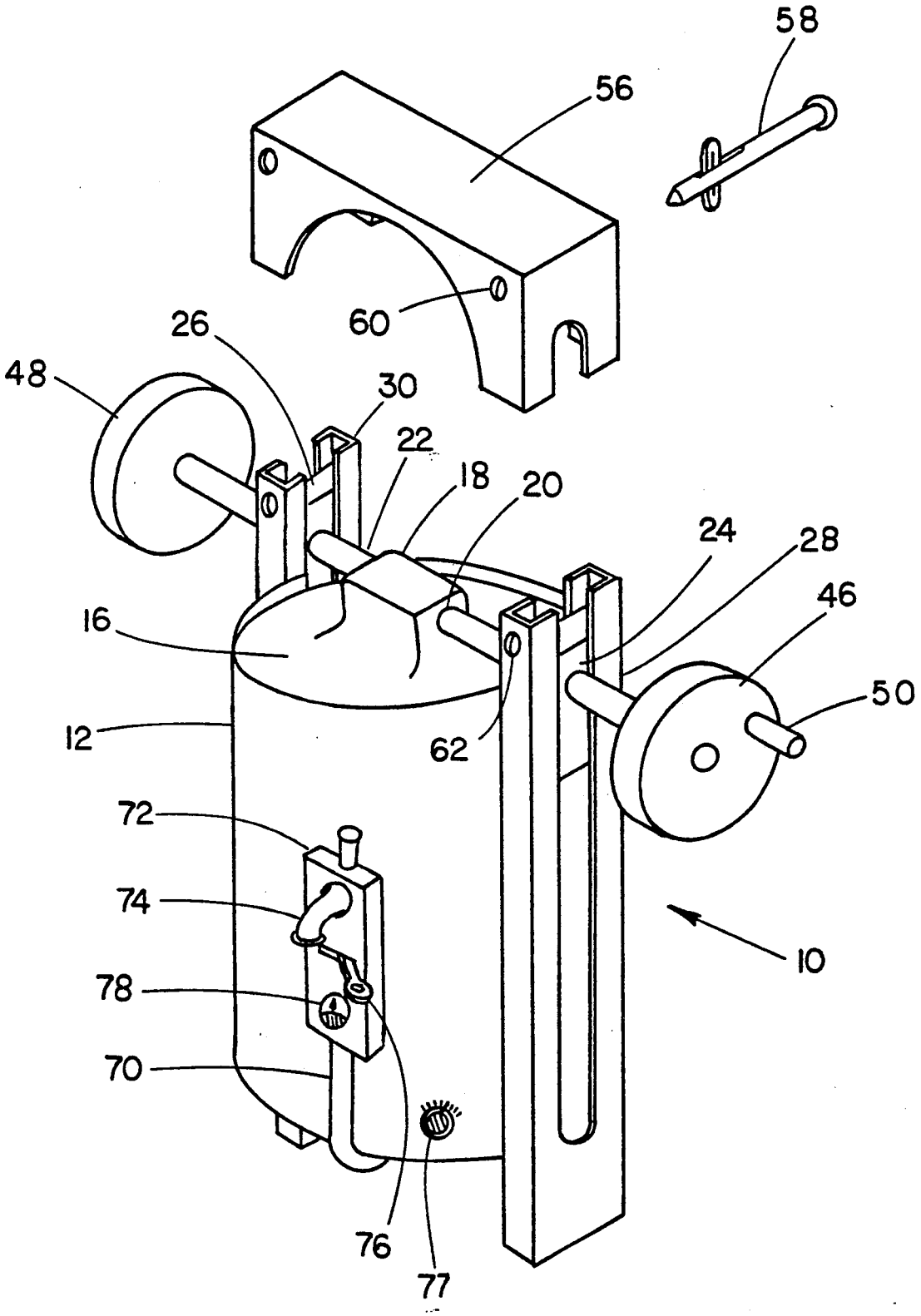
FIG. 1 is a pictorial view of the dispensing apparatus of the subject invention with portions exploded.

Referring now more particularly to FIGS. 1 through 11, there is provided carbonated beverage dispensing apparatus 10 including a hollow cylindrical drum or canister 12 which is preferably made of metal such as heavy gauge steel for receiving package 13 having a bladder 14 which contains a carbonated beverage. The types of carbonated beverages contained in bladder 14 includes such products as beer or soft drinks.

Dispensing apparatus 10 includes moveable pressure plate 16. Pressure plate 16 is adapted to move down to apply pressure to and collapse part of bladder 14 as the beverage is removed from the bladder, thereby limiting the volume of the void within bladder 14 so that the beverage does not lose its carbonation. Pressure plate 16 includes raised top 18 which has a tunnel 20 therethrough for receiving rod or drive shaft 22 which in turn is connected through gear boxes 24 and 26.

Gear boxes 24 and 26 are received respectively in channel assemblies 28 and 30 which are attached to canister 12 by means of bolts 31. Elongated gaps 32 are provided in the canister thereby permitting downward movement of drive shaft 22. The portions of the inside surfaces of channel assemblies 28 and 30 include opposing rows of rack teeth 36 and 38 which intermesh with the secondary gear drives 40 and 42 which are rotatably mounted in gear boxes 24 and 26. Each gear box has an identical gear configuration. For simplicity the gears of only one box will be disclosed. Drive shaft 22 is connected to main drive gear 44. As can be seen the diameter of the main drive gear is substantially smaller than the diameters of the secondary gears 40 and 42, thereby giving a substantial mechanical advantage with respect to the rotation of drive shaft 22 in connection with the downward movement of pressure plate 16 on the top of bladder 14.

Drive shaft 22 is connected to a pair of drive wheels 46 and 48. Hand crank 50 is connected to the ends of drive shaft 22 near the outer edge of each drive wheel 46 and 48. As the hand crank is turned in one direction, gears 40, 42 and 44 are turned, resulting in the downward movement of gear box 24, drive shaft 22, and thus pressure plate 16. When the drive wheels 46 and 44 are turned in the opposite direction, the pressure plate will come up. Ratchet 52 is connected above gear 44 so as to prevent the unintended movement of pressure plate 16 in the upward direction. When it is desired, however, to move the pressure plate in the upward direction, the ratchet is rotated by applying pressure to ratchet release button 53 so that tine 54 does not contact the teeth of drive gear 44.

Dispenser 10 further includes a top assembly 56 which is connected to the top portion of channel assemblies 28 and 30 and is held in place by pin 58 which is received through openings 60 and 62.

Dispenser apparatus 10 further includes bottom portion 64 having a known keg type tapping mechanism 66 and a tapping lever crank 68 attached thereto. Beverage tube 70 connects to tapping mechanism 66 and further to tapping assembly 72 which is attached to the outside surface of canister 12. Spigot assembly includes spigot 74, on and off valve control 76, and pressure gauge 78.

Figure 9:
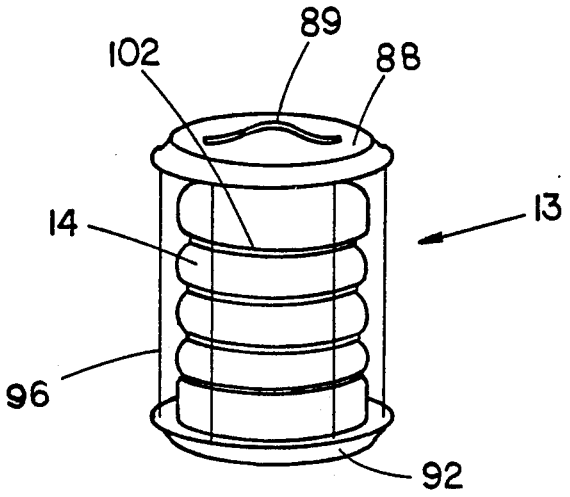
FIG. 9 is a pictorial view of the package of the subject invention which may be used with the apparatus of FIG. 1.
Figure 10:
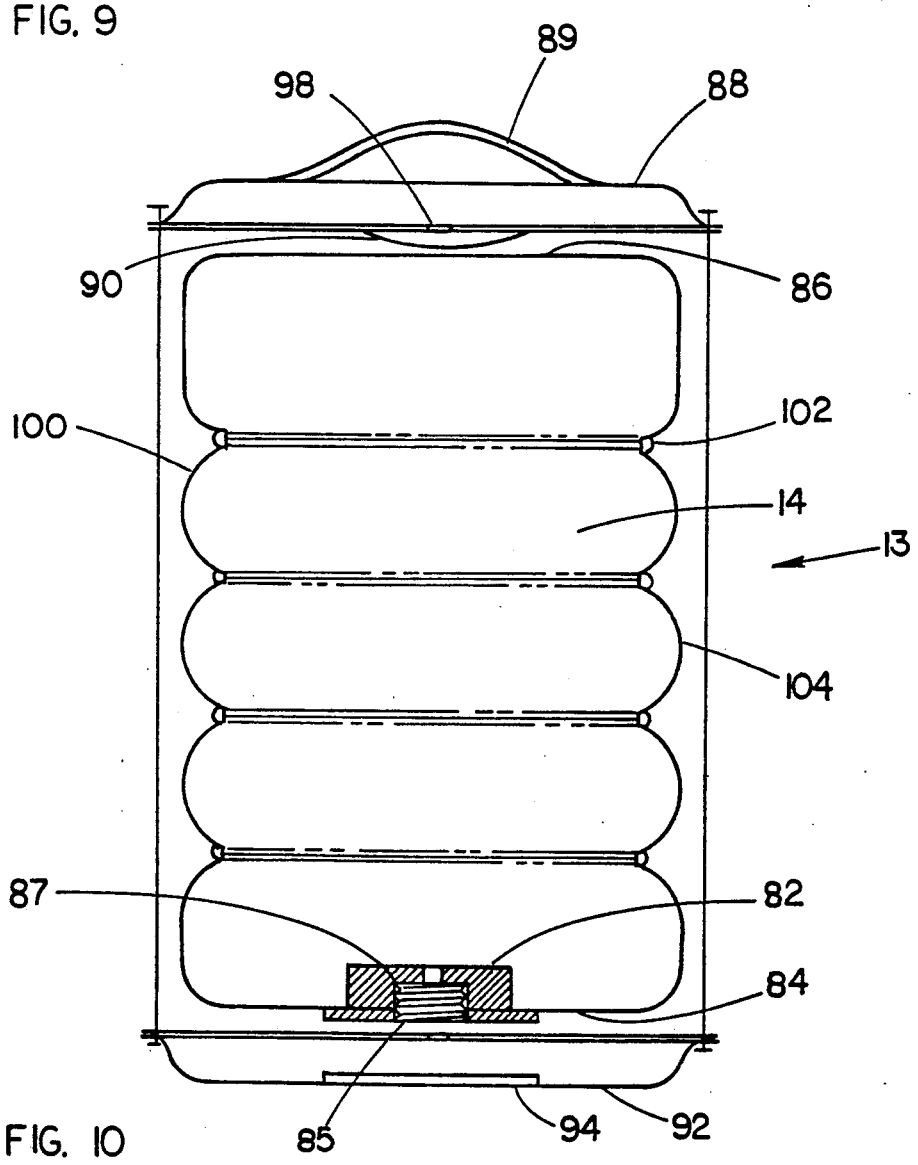
FIG. 10 is a side elevational view of the package shown in FIG. 9 which is partially exploded.
Figure 11:
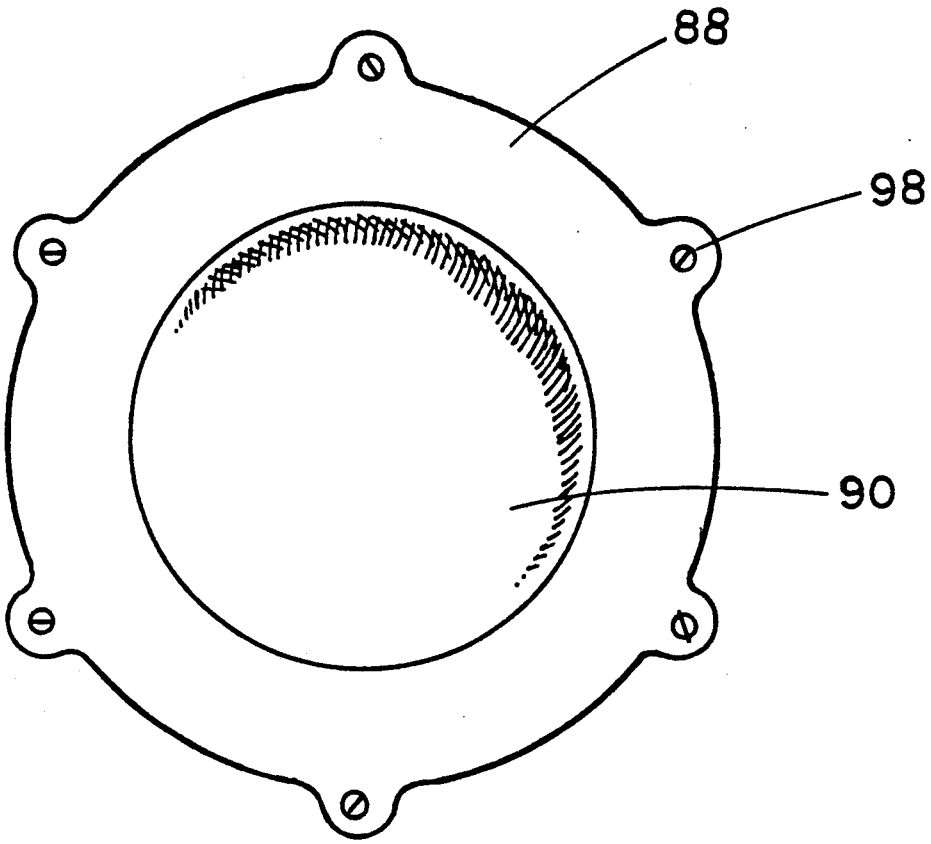
FIG. 11 is a bottom view of the top plate of the apparatus of FIG. 10.

Referring now more particularly to FIGS. 9 through 11, there is provided carbonated beverage package assembly 13 including collapsible bladder 14 which preferably is made of a semi-rigid material such as, for example, high density polyester in order to substantially reduce the leakage of gas ($CO_2$) through the beverage bladder. The bladder may also be lined with a thin aluminum coating or foil so as to provide additional strength and to further reduce or substantially eliminate the passage of gas through the bladder. The aluminum coating may also be sandwiched between two layers of plastic.

The bladder is adapted to be initially filled with the carbonated beverage so that approximately 80% to 90% of the space inside the uncollapsed bladder is taken up by the beverage. The remaining 10% to 20% is normally filled with high pressure air.

Tap valve assembly 82 is formed in the bottom 84 of the bladder 14 in a known fashion. Connector 85 is mounted in plastic mold 87 which may be glued to the inside surface of bottom 84 forming a seal. The valve assembly 82 is utilized to both fill the bladder and to empty it. The bladder 14 is filled at a bottling facility or brewery as one would fill a prior art keg by using known filling equipment.

Bladder 14 also has a top 86. In the preferred embodiment a top plate 88 having convex surface 90 rests against top 86. Also in the preferred embodiment, bottom plate 92 rests against bottom portion 84 of bottom plate 92. Bottom plate 92 includes opening 94 so that tap assembly 66 of the bladder 14 connects with tap valve assembly 82 of dispensing apparatus 10.

A plurality of straps 96 are used to tie top plate 88 to bottom plate 92. The straps are received in holes 98 in the top and bottom plates so as to hold the package assembly 13 together as a package. The sides 100 of bladder 14 are preferably rib shaped. The rib shape is provided by the use of a plurality of straps 102 which are tightly tied about the bladder resulting in a plurality of ribs 104. This rib structure together with horizontal straps 102 add structural strength to the bladder. The rib structure also enables an orderly accordion like collapse of the bladder 14 as pressure plate 16 is lower and applies pressure to the top 86 of the bladder.

Top plate 88 includes handle 89 so that the package 13 may be more easily transported from place to place. Preferably the top and bottom plates are made of stamped heavy gauge metal. Also, preferably, the horizontal and vertical straps 96 and 102 are made of nylon.

Figure 2:
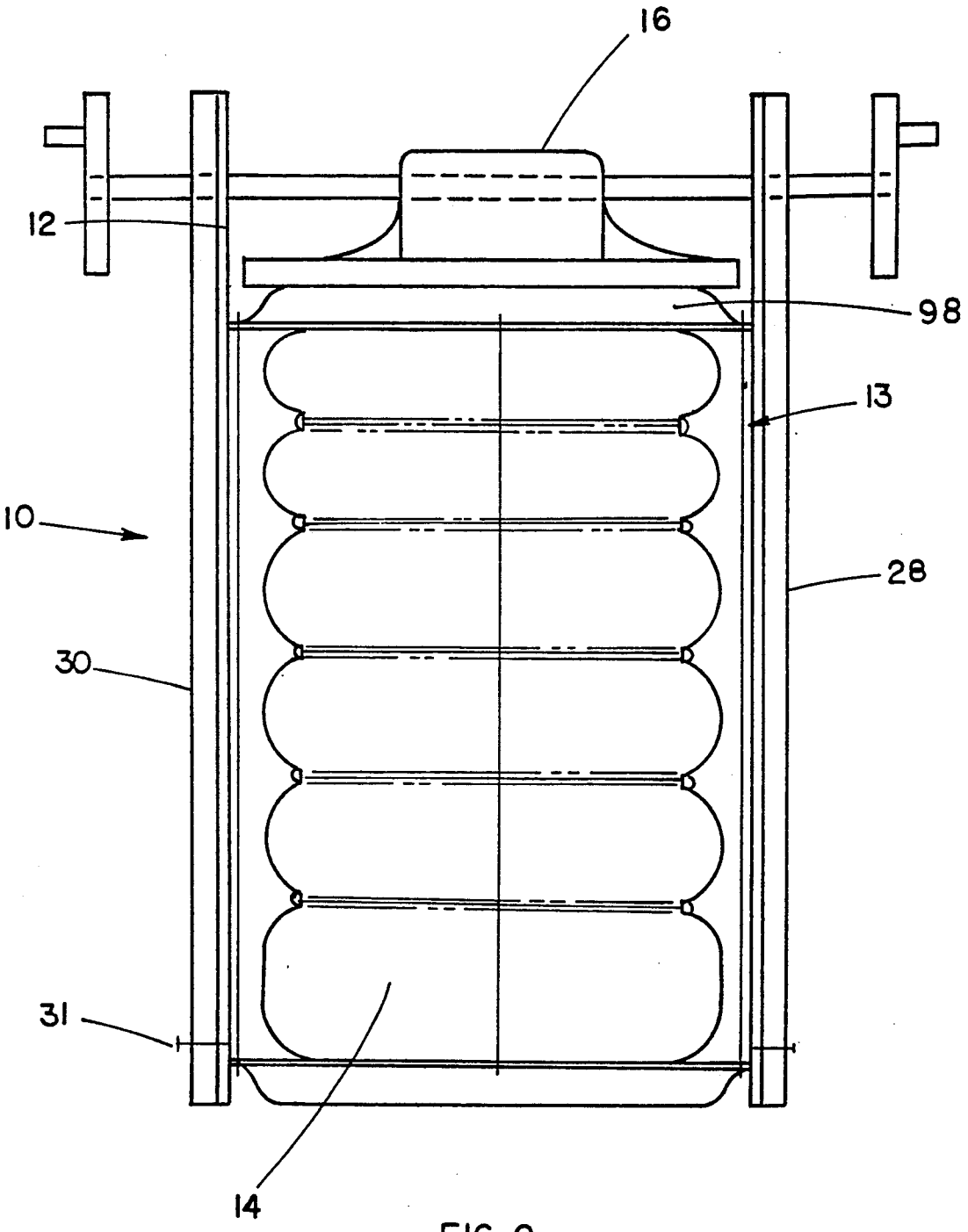
FIG. 2 is a side elevational view of the apparatus of FIG. 1 with portions removed and showing the package of FIG. 9 received therein.
Figure 3:
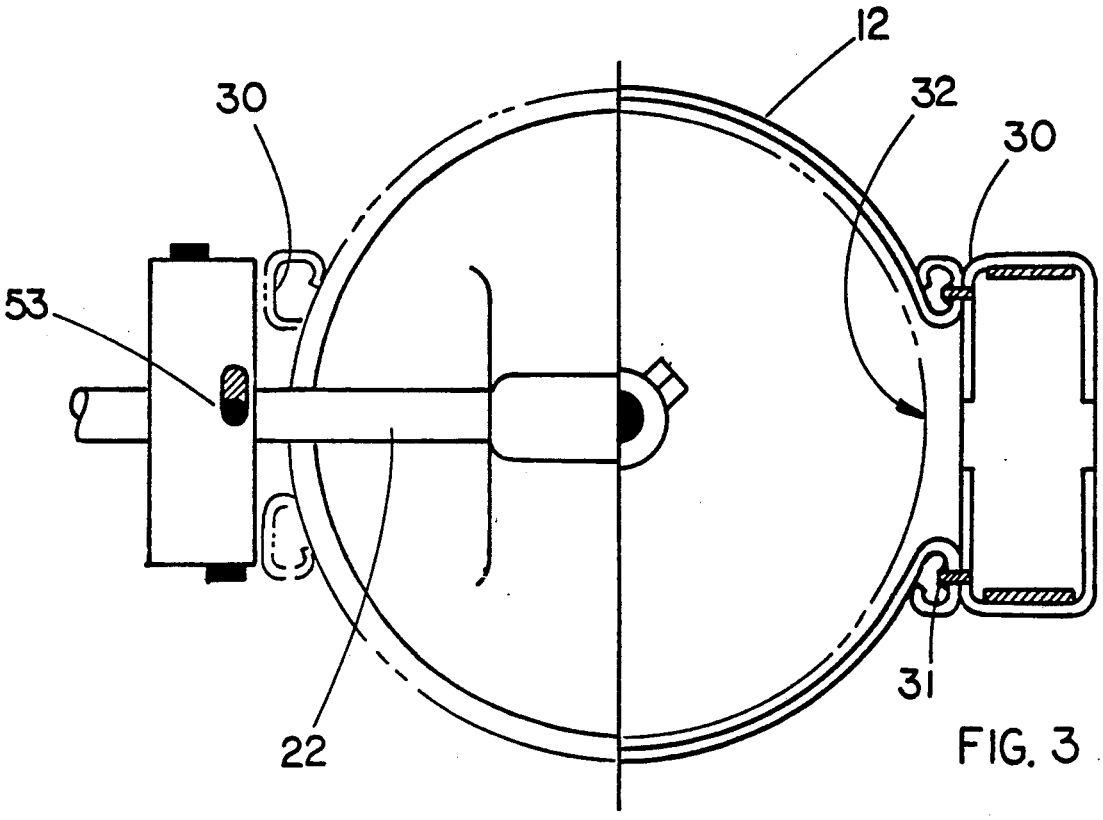
FIG. 3 is a top view of the apparatus of FIG. 1 with portions removed, particularly portions of the right side removed.
Figure 4:
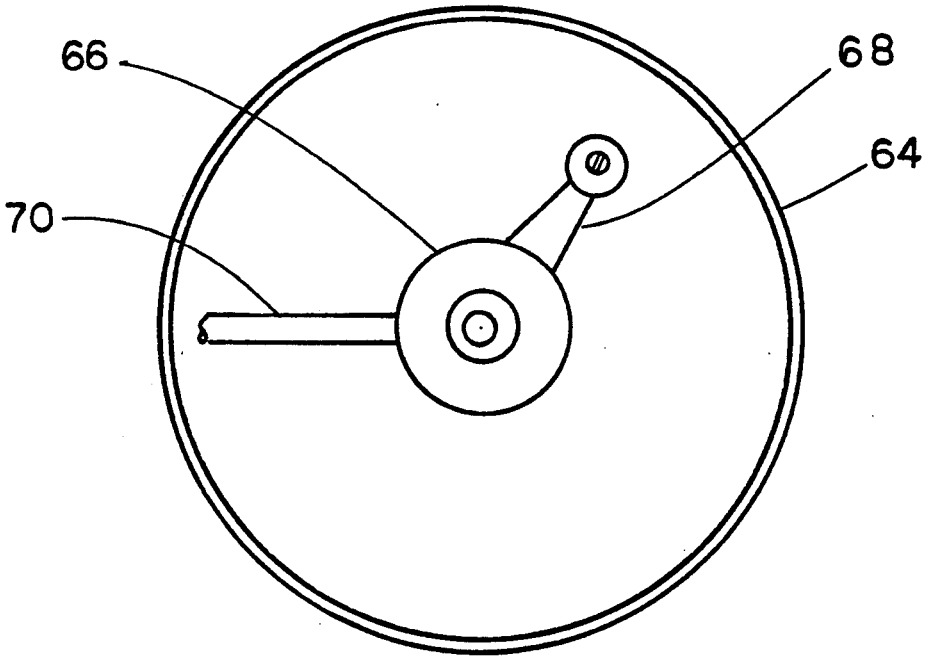
FIG. 4 is a bottom view of the apparatus of FIG. 1 with portions removed.
Figure 5:
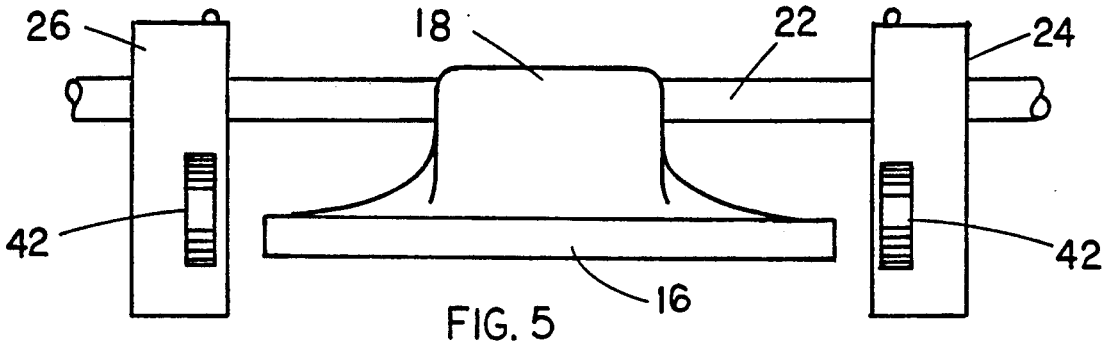
FIG. 5 is a side elevational view of the top part of the apparatus of FIG. 1.
Figure 6:
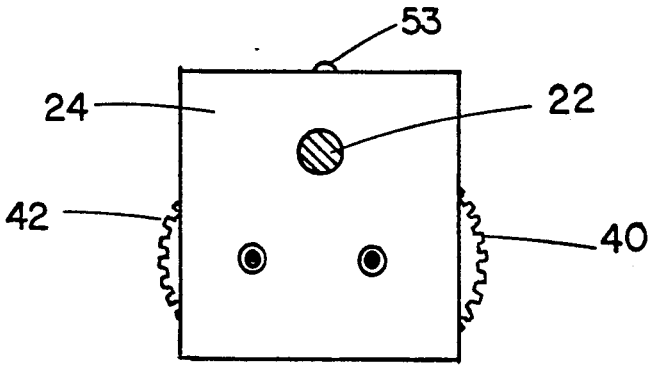
FIG. 6 is a side elevational view of the gear box portion of the apparatus of FIG. 1.
Figure 7:
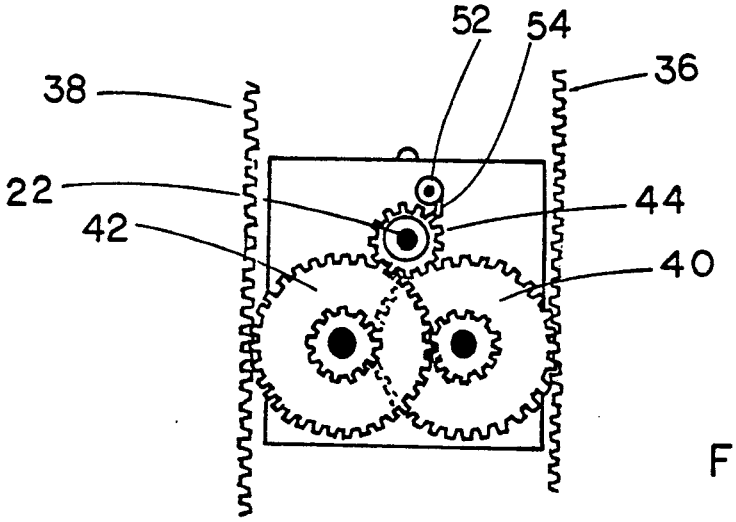
FIG. 7 is a side elevational view showing the gears enclosed in the gear box of FIG. 6 and portions of the associated rack.
Figure 8:
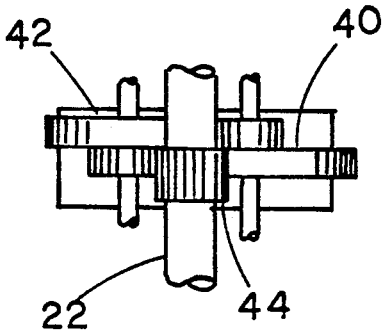
FIG. 8 is a top view of the gears of FIG. 7.

As can be seen from FIG. 2, portable package 13 including bladder 14, is placed inside of canister 12 after the top assembly 56, pressure plate 16, and the gear boxes 24 and 26 and drive shaft 22 have been removed therefrom. After the package assembly 13 is in place within the canister, the pressure plate 16, gear boxes 24 and 26, and drive shaft 22 are then placed back in their positions as shown in FIG. 1 after which the top assembly 56 is mounted to the top part of the dispenser assembly 10. The pressure plate 16 is lowered until it engages with top plate 98 by rotating wheels 46 and 48. The tapping lever 68 is then rotated causing the male threads of tapping assembly 66 to intermate with the female threads of connector 85 of tap valve assembly 82 forming a fluid path from the inside of bladder 14 through tap valve assembly 82, through beverage tube 70 to the spigot assembly 72.

When it is desired to dispense the carbonated beverage, valve control 76 is moved to the open position thereby permitting the beverage to pass through spigot 74. Pressure gauge 78 is monitored by the user and as the pressure drops to a predetermined position the user rotates drive wheels 46 and/or 48 by hand so as to cause the pressure plate 16 to move downwardly thereby collapsing a portion of bladder 14 thereby maintaining the preferred pressure and thus carbonation. Thus the potential movement of the carbon dioxide gas or carbonation from the beverage to any void which may have been created by the loss of liquid from the bladder is substantially eliminated.

Vertical straps 96 may be severed once the beverage package 80 has been placed in canister 12. This may be more readily accommodated through the use of holes (not shown) in the pressure plate 16 adjacent to holes 98 in the top plate.

Thus an improved carbonated beverage dispensing system is provided which utilizes a unique carbonated beverage package which is portable and which may be disposable or may be refillable, and further which utilizes a unique dispensing apparatus having a pressure plate which collapses the semi-rigid bladder associated with the beverage package in a controlled fashion so as to avoid the loss of carbonation from the beverage.

The beverage within the bladder 14 may be kept cold by the use of known refrigeration means (not shown) including refrigeration coils affixed to the side of canister 12 as well as known associated refrigeration condenser and compressor. An adjustable thermostat and temperature control 77 may also be attached to canister 12 and used in conjunction with the refrigeration system in a known fashion.

From the foregoing description of the preferred embodiments of the invention, it would be apparent that many modifications may be made therein without departing from the true spirit and scope of the invention. It is intended in the appended claims to cover all modifications within the scope of the invention.

I claim:

1. A package for containing a carbonated beverage comprising:

a bladder; said bladder adapted to receive the beverage;

means for permitting the beverage to be removed from said bladder; a substantial portion of said bladder being made of a semi-rigid material whereby said bladder will not normally collapse when substantially filled with the beverage but will collapse, thereby reducing its volume, when substantial external pressure is applied thereto as a portion of the beverage is removed therefrom, said bladder including a top and a bottom; a top plate contacting said top of said bladder and a bottom plate contacting said bottom of said bladder; carrying means provided on said top plate; means for securing said bottom plate to said top plate thereby enhancing the structural integrity of said package to enable said package to be moved from place to place when substantially filled with the beverage; said means for securing including a plurality of vertical straps connected to said top plate and to said bottom plate.

2. A package as set forth in claim 1 wherein said semi-rigid material is plastic.

3. An package as set forth in claim 2 wherein said plastic is polyester.

4. A package as set forth in claim 2 further including a layer of aluminum foil forming a part of said package.

5. A package as set forth in claim 1 wherein said bladder has a generally cylindrical shape and includes a substantially curved wall, a plurality of ribs formed in said wall.

6. A package as set forth in claim 1 further including a convex portion in said top plate.

7. A package for containing a carbonated beverage comprising:

a bladder; said bladder adapted to receive the beverage;

means for permitting the beverage to be removed from said bladder; a substantially portion of said bladder being made of a semi-rigid material whereby said bladder will not normally collapse when substantially filled with the beverage but will collapse, thereby reducing its volume, when substantial external pressure is applied thereto as a portion of the beverage is removed therefrom; said bladder having a generally cylindrical shape and includes a substantially curved wall; a plurality of ribs formed in said wall; said ribs are maintained by a plurality of spaced apart straps surrounding said bladder.

8. A carbonated beverage dispensing apparatus comprising:

a housing of robust construction; said housing adapted to receive a bladder containing a carbonated beverage;

dispensing means attached to said housing and adapted to be connected to said bladder;

a moveable pressure plate forming a top of said housing;

means for moving said pressure plate downwardly thereby collapsing a portion of the bladder whereby gas pressure is maintained within the bladder so that the carbonation of the beverage is substantially maintained as the beverage is dispensed; said means for moving said pressure plate includes a mechanism for providing a mechanical advantage thereby enabling a substantially constant force be applied to said pressure plate; said mechanism for providing mechanical advantage includes a plurality of gears; at least two of said gears being disposed on each opposing side of said housing.

9. An apparatus as set forth in claim 8 further including at least one channel attached to said housing; said channel including at least one rack having a plurality of teeth; said teeth of said rack intermeshing with said gears.

10. An apparatus as set forth in claim 9 further including a ratchet contacting at least one of said gears for preventing upward movement of said pressure plate.

11. An apparatus as set forth in claim 8 further including a shaft attached to said gears and to said pressure plate.

12. An apparatus as set forth in claim 11 further including at least one wheel attached to said shaft for rotating said shaft and said gears thereby moving said pressure plate.

13. An apparatus as set forth in claim 8 wherein said housing includes a bottom; a portion of said bottom adapted to be connected to the bladder and further connected to said dispensing means.

14. An apparatus as set forth in claim 9 further wherein said at least one channel includes a pair of channels attached on opposite sides of said housing; each of said channels including a rack having a plurality of teeth.

15. A carbonated beverage dispensing system comprising:

a generally cylindrically shaped housing;

a portable package including a bladder containing the beverage; said package removably received in said housing; said bladder having a generally cylindrical shape; said bladder having a top, a bottom, and at least one wall; said bladder being made of a semi-rigid material; said bladder being collapsible;

means for permitting the removal of the beverage from said bladder;

a moveable pressure plate forming a top of said housing;

means for moving said pressure plate downwardly thereby collapsing a portion of said bladder whereby gas pressure is maintained within the bladder so that the carbonation of the beverage is substantially maintained as the beverage is dispensed; said means for moving said pressure plate includes a mechanism for providing a mechanical advantage thereby enabling a substantially constant force to be applied to said pressure plate; said mechanism for providing a mechanical advantage includes a plurality of gears; at least two of said gears being disposed on each opposing side of said housing.

16. An apparatus as set forth in claim 15 wherein said means for moving said pressure plate downwardly includes a drive shaft rotatably attached to said pressure plate; said drive shaft connected to said gears.

17. An apparatus as set forth in claim 16 further including a pair of channels receiving said gears; each of said channels including at least one elongated rack having teeth intermeshing with said gears.

18. A carbonated beverage dispensing system comprising:

a generally cylindrically shaped housing;

a portable package including a bladder containing the beverage; said package removably received in said housing; said bladder having a generally cylindrical shape; said bladder having a top, a bottom, and at least one wall; said bladder being made of a semi-rigid material; said bladder being collapsible;

means for permitting the removal of the beverage from said bladder;

a moveable pressure plate forming a top of said housing;

means for removing said pressure plate downwardly thereby collapsing a portion of said bladder whereby gas pressure is maintained within the bladder so that the carbonation of the beverage is substantially maintained as the beverage is dispensed; said means for moving said pressure plate includes a mechanism for providing a mechanical advantage; said mechanism for providing a mechanical advantage includes a plurality of gears; said wall of said bladder contains a plurality of ribs; said plurality of ribs in said bladder are formed by a plurality of spaced apart straps received about the wall of the bladder.

19. A package for containing a carbonated beverage comprising:

a bladder; said bladder adapted to receive the beverage;

means for permitting the beverage to be removed from said bladder; a substantial portion of said bladder being made of a semi-rigid material whereby said bladder will not normally collapse when substantially filled with the beverage but will collapse, thereby reducing its volume, when substantial external pressure is applied thereto as a portion of the beverage is removed therefrom, said bladder including a top and a bottom; a top plate contacting said top of said bladder and a bottom plate containing said bottom of said bladder; means for securing said bottom plate to said top plate thereby enhancing the structural integrity of said package to enable said package to be moved from place to place when substantially filled with the beverage; said bladder has a generally cylindrical shape and includes a substantially curved wall; a plurality of ribs formed in said wall; said ribs are maintained by a plurality of spaced apart straps surrounding said bladder.

* * * * *